US006951283B2

(12) United States Patent
Savoie

(10) Patent No.: US 6,951,283 B2
(45) Date of Patent: Oct. 4, 2005

(54) STORAGE AND TRANSPORT SYSTEM FOR COLLAPSIBLE TRADESHOW DISPLAYS

(75) Inventor: Troy S. Savoie, Burnsville, MN (US)

(73) Assignee: Skyline Displays, Inc., Eagan, MN (US)

( * ) Notice: Subject to any disclaimer, the term of this patent is extended or adjusted under 35 U.S.C. 154(b) by 195 days.

(21) Appl. No.: 10/262,580

(22) Filed: Oct. 1, 2002

(65) Prior Publication Data

US 2003/0075476 A1 Apr. 24, 2003

Related U.S. Application Data

(60) Provisional application No. 60/351,677, filed on Jan. 25, 2002, and provisional application No. 60/326,518, filed on Oct. 1, 2001.

(51) Int. Cl.[7] ..... B65D 77/00

(52) U.S. Cl. ..... 206/577; 206/485; 206/443; 211/70.1

(58) Field of Search ..... 206/443, 485, 206/577; 211/13.1, 70.1; 220/62.19, 827, 831, 832; 312/319.1

(56) References Cited

U.S. PATENT DOCUMENTS

| | | | |
|---|---|---|---|
| 509,653 | A | 11/1893 | Coleman |
| 747,741 | A | 12/1903 | Marsh |
| 1,702,996 | A | 2/1929 | Coppage |
| 1,997,241 | A | 7/1935 | Templin |
| 2,058,682 | A | 10/1936 | Green |
| 2,115,422 | A | 4/1938 | Kahle |
| 2,118,735 | A | 5/1938 | Money |
| 2,486,460 | A | 11/1949 | Bonenberger |
| 2,489,493 | A | 11/1949 | Kuenzie |
| 2,602,252 | A | 7/1952 | Shinn |
| 3,010,775 | A | 11/1961 | Giovannelli |
| 3,087,767 | A | 4/1963 | Schell |
| 3,186,781 | A | 6/1965 | Lax |
| 3,510,187 | A | 5/1970 | Schreyer |
| 3,672,741 | A | 6/1972 | Clark |
| 3,826,206 | A | 7/1974 | Ruggles |
| 4,400,043 | A | 8/1983 | Rossow |
| 4,417,774 | A | 11/1983 | Bevan et al. |
| 4,436,353 | A | 3/1984 | Tucker |
| 4,591,215 | A | 5/1986 | Robbins |
| 4,652,062 | A | 3/1987 | Greenwood |
| 4,786,122 | A | 11/1988 | Nichoalds |
| 4,819,567 | A | 4/1989 | Thompson et al. |
| 4,820,003 | A | 4/1989 | Lloyd |
| 4,856,625 | A | 8/1989 | Oshida |
| 4,893,885 | A | 1/1990 | Borello |
| 4,991,813 | A | 2/1991 | Beaulieu |
| D317,469 | S | 6/1991 | Beaulieu |
| 5,096,056 | A | 3/1992 | Garcia |
| 5,162,028 | A | 11/1992 | Wilkinson |

(Continued)

FOREIGN PATENT DOCUMENTS

| | | |
|---|---|---|
| GB | 315050 | 7/1929 |
| GB | 628310 | 8/1949 |
| GB | 807047 | 1/1959 |
| WO | WO 86/03265 | 6/1986 |
| WO | WO 00/50124 | 8/2000 |

*Primary Examiner*—Jacob K. Ackun, Jr.
(74) *Attorney, Agent, or Firm*—Patterson, Thuente, Skaar & Christensen, P.A.

(57) ABSTRACT

The storage and transport system for collapsible tradeshow displays preferably comprises a crate and framework in combination with components of a collapsible display system. By providing a crate and framework for more vertical storing and accessing the components and for organizing the components as they are placed in the crate, users may more efficiently set up and tear down the display system where there is limited floor space. The crate is durable and the framework securely holds components in place for safe and secure transportation.

36 Claims, 9 Drawing Sheets

U.S. PATENT DOCUMENTS

| | | | | |
|---|---|---|---|---|
| D333,322 | S | | 2/1993 | Lindblom et al. |
| 5,207,723 | A | | 5/1993 | Newby, Sr. |
| D349,608 | S | | 8/1994 | Savoie |
| 5,375,641 | A | | 12/1994 | Schlueter |
| 5,402,738 | A | | 4/1995 | Carr et al. |
| 5,486,043 | A | | 1/1996 | Carr et al. |
| 5,590,939 | A | | 1/1997 | Piontek |
| 5,628,400 | A | | 5/1997 | Feder |
| 5,718,494 | A | | 2/1998 | Luddemann |
| 6,098,803 | A | * | 8/2000 | Tanaka et al. ..... 206/443 |

* cited by examiner

STORAGE AND TRANSPORT SYSTEM FOR COLLAPSIBLE TRADESHOW DISPLAYS

RELATED APPLICATIONS

This application claims the benefit of U.S. Provisional Patent Application No. 60/326,518, filed Oct. 1, 2001 and U.S. Provisional Patent Application No. 60/351,677, filed Jan. 25, 2002, which are hereby incorporated herein in their entirety by reference.

FIELD OF THE INVENTION

The present invention related to receptacles or enclosures combined with article supporting means for collapsible tradeshow displays. More particularly, the invention relates to a storage and transport system for collapsible tradeshow displays, including a crate constructed to easily access display components and a framework to organize and secure the components within the crate.

BACKGROUND OF THE INVENTION

Structures for transporting systems of multiple components are important to maximizing the use of these systems with a minimum of effort, thereby allowing users to focus more of their time, attention, and efforts on obtaining the benefits of these systems. For example, tradeshow displays are a vital part of exposing products and services to buyers. These displays are designed to be lightweight, modular, and collapsible so that they can be transported easily from tradeshow site to tradeshow site for temporary use. Such displays generally have rigid panels with graphical surfaces that need protection during shipment; structural frameworks that disassemble or collapse; flexible sheet material, often with graphics, that needs to be rolled up and protected; and various other components. Transporting a system of multiple display components is a logistically complex activity that can be simplified and minimized with respect to time, effort, and space by a structure for storing the system that facilitates both the assembly of the system and the disassembly and safe storage of the system.

A well designed structure for a storage and transportation crate or container or case has several minimally desirable attributes. First, the crate should be shippable. The size of the crate must fit onto those forms of transportation that are intended to be used for its convenient transport. Second, the crate should have a strong outer shell to withstand the stresses and strains of transporting a system of components safely. The crate should not inadvertently open up during shipping, and should be constructed to allow components to be efficiently placed into, effectively protected within, and easily retrieved from the crate. Third, the crate should be lightweight and as compact as possible to minimize transportation costs.

Many storage devices use a front or side opening to access the interior of the device. These devices often contain shelving that limits their use to storage of smaller items. Examples of these kinds of devices are disclosed in Giovannelli, U.S. Pat. No. 3,010,775, Transportable Storage Device; Robbins, U.S. Pat. No. 4,591,215, Merchandising and Display Device; and Newby, Sr., U.S. Pat. No. 5,207,723, Portable Sectional Storage Cabinet. An example of a front opening device without shelves is Nichoalds, U.S. Pat. No. 4,786,122, Cabinet Construction. Vertical storage of objects in these kinds of devices is restricted by the height of the opening and the distance between shelves. Horizontal or vertical storage of objects in these kinds of devices is not readily adaptable to tradeshow and similar environments where floor space is purchased and often only a limited amount of space is available within which to work. This limitation also becomes problematic when the cover over the opening is a door that is swung outwardly to access the contents of the device.

Other storage devices use a top opening to access the interior of the device. Some devices have top covers that are removable from their base portions, such as those disclosed in Luddemann, U.S. Pat. No. 5,718,494, Convertible Storage System, or the XP Expandable Case manufactured by A & J Cases. Removable covers likewise present floor space problems because the covers must be set aside somewhere, which covers become an inconvenience while trying to work around them. Some devices have hinged covers, such as those disclosed in Templin, U.S. Pat. No. 1,997,241, Display Case, and Karten et al., U.S. Pat. No. 5,997,112, Multipurpose Storage Case and Display Cabinet. Both of these devices include covers having a free range of motion so that the covers are not suspendable above the device. As a consequence, such a cover will remain only in a completely closed position or in a position where its weight no longer resides over the base of the device. Thus, the cover is not very useful as a means for holding components, tools, information, or other similar resources.

Still other devices similar to those described above have partitions or dividers inside the devices to assist users in organizing the intended contents. Some devices have permanently constructed dividers, such as those that appear in Greenwood, U.S. Pat. No. 4,652,062, Cart Particularly Designed for Responding to Emergencies. Some devices have slots in their walls or shaped walls for reconfiguring dividers into a limited number of permutations, such as Burgess, Jr. et al., U.S. Pat. No. 5,873,643, Multi-Compartment Cabinet, or Carr et al., U.S. Pat. No. 5,486,043, Carrying Case Having Detachable Step Stool. The previously mentioned device in Newby, Sr. is another example. And some containers have a more flexible system of dividers, such as Garcia, U.S. Pat. No. 5,096,056, Momento Box, wherein slots in dividers are used to assemble the dividers in a cross-hatched pattern, which structure is then placed inside the device.

Although numerous attempts have been made to make storage devices as convenient and adaptable as possible, there are one or more desirable attributes that previous devices have not incorporated. For example, it would be desirable to have a cover that is suspendable above the base portion of a device so that the cover does not become lost and stays out of the way of users of the device without taking floor space. Suspending the cover above the base portion would also allow a user to easily access items stored under the cover, such as instruction manuals, and the weight of the cover would remain over the base of the device to help maintain the device's stability. Finally, it would be desirable to have a device wherein the front of the base portion has a height that is low enough to allow a user to easily view the contents of the device and access the interior of the device to store and retrieve components, tools, information, and other resources, and to have a framework for organizing the contents inside the device that is effective, convenient, and possibly reconfigurable with few limitations.

SUMMARY OF THE INVENTION

The storage and transport system for collapsible tradeshow displays preferably comprises a crate and framework in combination with components of a collapsible display system. By providing a crate and framework for more vertical storing and accessing the components and for organizing the components as they are placed in the crate, users may more efficiently set up and tear down the display system where there is limited floor space. The crate is durable and the framework securely holds components in place for safe and secure transportation.

Preferred embodiments of the storage and transport system for collapsible tradeshow displays are organized storage systems that include a crate allowing a user to have easy access to the components of a collapsible display stored in the storage compartment of the crate and a framework for organizing such components in an orderly manner. The crate and framework provide a system for storing, transporting, receiving, and retrieving collapsible display components and incorporate many advantages and conveniences into the structure. The body of the crate is durable, double-walled, and rotationally molded from plastic. The front of the base portion of the crate is lower than the back, preferably so users can more easily view and access components in the storage compartment of the crate. The crate and framework are designed for use in situations having limited floor space by channeling storage and retrieval activity in a vertical direction, by hinging the upper portion or top of the crate to the base portion of the crate, and by supporting the upper portion above the base portion while the crate is open. Also, the framework in one embodiment is reconfigurable by repositioning parts, without disassembling the frame, primarily in a vertical direction, and thus kept out of the way of other activities without being misplaced. Adjustments can be made without totally separating frame members from the framework and without removing fasteners.

Supporting the upper portion of the crate over the base portion has additional advantages. It can continue-to serve-as a cover while the crate is open, it remains within convenient reach of a user so that components, tools, information, and similar resources can be stored underneath the upper portion, and the range of the upper portion can be limited so that the center of gravity of the crate, and preferably the weight of the upper portion itself, remains over the base portion of the crate to provide good stability.

In preferred embodiments, the crate includes a base portion that further includes a bottom and at least one base portion wall. The base portion wall forms a storage compartment with the bottom and has a top circumferential edge defining an opening into the storage compartment. The front of the storage compartment is lower than the back so that users can more easily view and access the storage compartment. The crate also has an upper portion and a brace. The upper portion is further comprised of a top and at least one upper portion wall. The upper portion wall forms an overhead enclosure with the top and has a bottom circumferential edge to abut with the top circumferential edge of the base portion to enclose the storage compartment. The upper portion is connected to the back of the base portion with a hinge, so that the crate may be opened and closed, and the brace is connected to the base portion and the upper portion to suspend the upper portion above the base portion while the crate is open.

In preferred embodiments, the framework is easy to use and relatively lightweight. In one preferred embodiment, the framework is comprised of at least one retainer panel secured to the crate, preferably the base portion. The at least one retainer panel has at least one, and preferably a plurality, of apertures through its planar surface to receive components of a collapsible display. The apertures preferably may be sized and shaped to receive certain components so that there is an order to their storage. Retainer panels may be positioned one above the other, the apertures of which may be specifically sized and shaped to receive components of predetermined shapes.

An alternative embodiment is highly versatile in that it can be reconfigured in an almost unlimited number of ways. This feature is significant because users can reconfigure the framework to provide an order to components stored and retrieved, thereby reducing the amount of time needed for setups and teardowns. The framework includes at least one tray or retainer panel having a plurality of flutes. Components are stored in the channels formed by the flutes and held in place by the flutes. The framework also has a frame that further includes at least one retainer panel securing member for positioning and securing the at least one retainer panel to the frame by the at least one retainer panel securing member. The at least one retainer panel securing member securing the at least one retainer panel is movable between an adjustment position for moving the retainer panel and a securing position for securing the retainer panel. This framework may be used with or independently of the crate, and the crate may be used independently of this framework.

Components of collapsible displays may be of any of a number of displays. Examples of such displays are illustrated in U.S. Pat. Nos. Des. 349,608; Des. 333,322; Des. 317,469; 4,991,813; 5,375,641; and U.S. Provisional Patent App. No. 60/390,489. These patents and patent applications are hereby incorporated herein in their entirety by reference. Moreover, particular embodiments of the framework may be used with other crate configurations, for example side-opening crates. The invention includes the method of manufacturing and assembling the crates as well as the frameworks.

DESCRIPTION OF PREFERRED EMBODIMENTS

Figure 1:
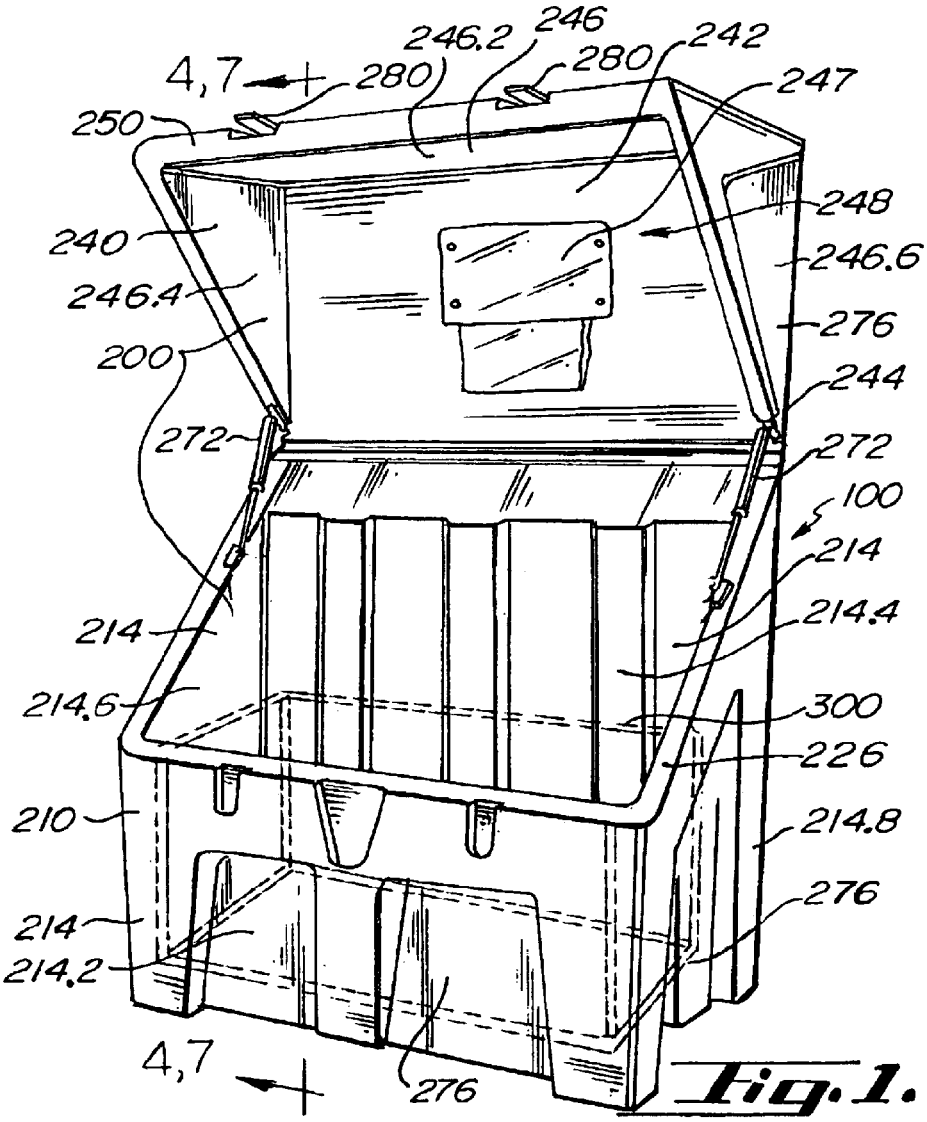
FIG. 1 is a perspective view of the crate in accordance with the present invention.
Figure 3:
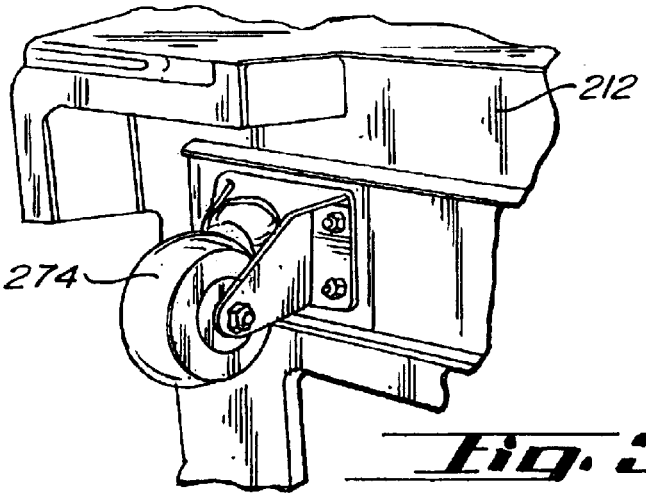
FIG. 3 is a perspective view of a bottom corner of the crate showing a wheel attachment.
Figure 2:
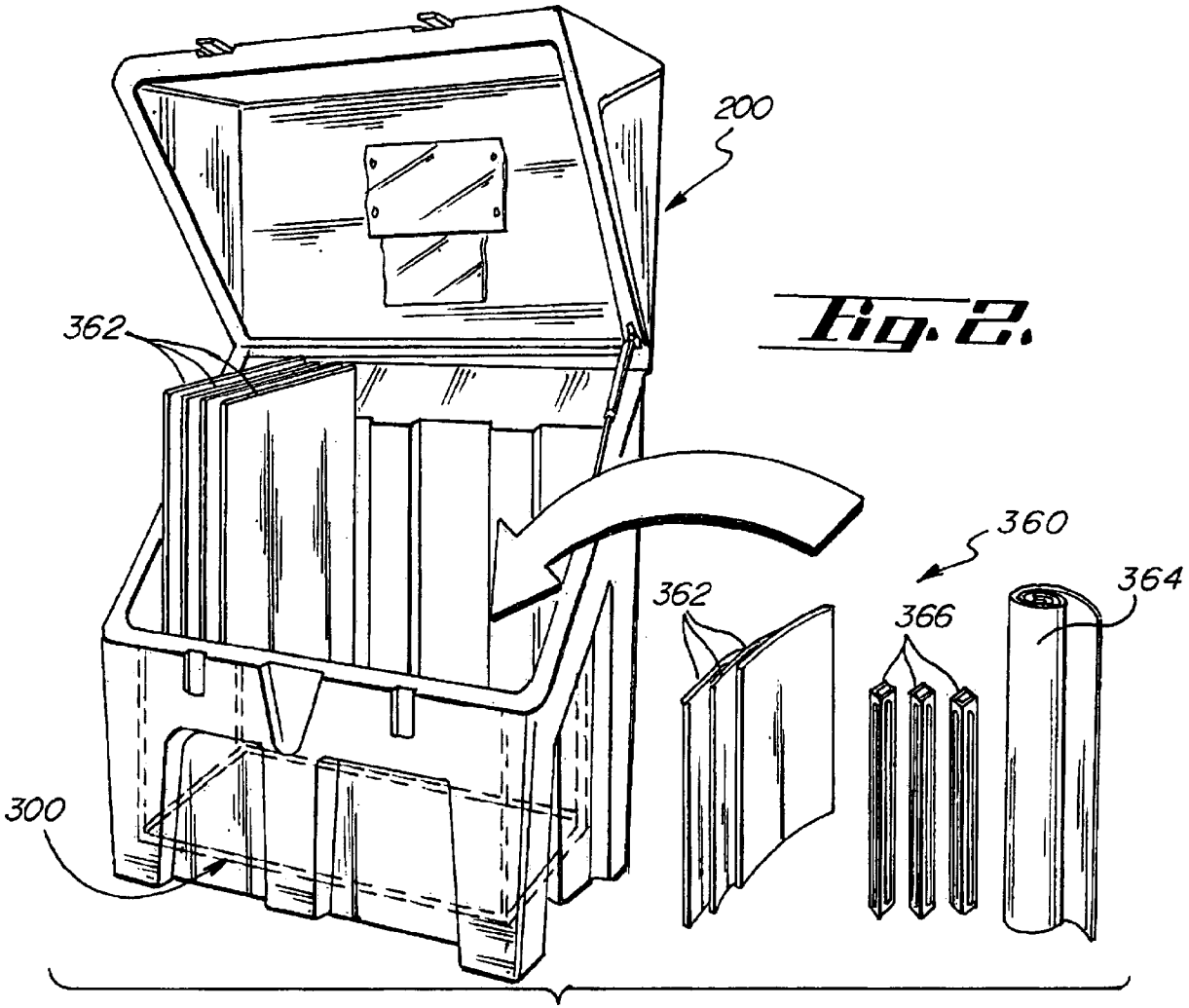
FIG. 2 is a perspective view of the crate in combination with a modular, collapsible display system.

The preferred embodiment relates to a storage and transport system for tradeshow displays in accordance with the present invention. As shown in FIGS. 1–7, an embodiment of the present invention introduces an organized storage system 100 for storing components of modular or collapsible display systems in an orderly manner. The organized storage system 100 includes a crate 200 and a framework 300 that is integrable with the crate 200 and reconfigurable in one embodiment.

Referring to FIGS. 1, 2, 3, and 4, the crate 200 includes a base portion 210, a closure portion configured as an upper portion 240, and at least one brace 272. A preferred embodiment of the crate 200 is sized to fit through a standard sized cargo hold door on a commercial airliner. The crate 200 is generally rectilinear, although the sides of the crate may taper inwardly from top to bottom and other shapes, such as cylindrical, spherical, or even an irregular shape, are also possible. The crate 200 is comprised primarily of two parts. A lower part or base portion 210 is rotationally molded from plastic and double-walled. The base portion 210 has a floor or bottom 212 and four base portion walls 214, a base front wall portion 214.2, a base rear wall portion 214.4, a base left wall portion 214.6, and a base right wall portion 214.8. The bottom 212 and the base portion walls together define a storage compartment 216 into which components, tools, and informational materials can be stored and from which they can be retrieved. Preferably, the bottom 212 is generally rectangular and the four base wall portions 214.2, 214.4, 214.6 and 214.8 are generally rectangular or trapezoidal walls, each adjoined to two others at two of its opposing edges. In a preferred double-wall configuration, the base portion walls 214 have an inner wall 215 and an outer wall 215.2, each having an inwardly facing surface and an-outwardly facing surface. The storage compartment 216 has a front 218 with a height 222 and a back 220 with a height 224. The front height 222 is preferably lower than the back height 224 so that a person of generally average height can easily view and access the storage compartment 216. For example, the front height in the preferred embodiment is approximately 26 inches from the bottom 212 of the crate, although any height in a range up to 60 inches might be convenient for the appropriate crate. The transition between the front 218 and back 220 of the storage compartment 216 is preferably linear, although it could also be nonlinear. The base portion walls 214 have a top circumferential edge 226 that defines a storage compartment opening 228 for accessing the storage compartment 216. This top circumferential edge 226 may be flat or may have ridges and recesses (not shown) for aligning the base portion 210 with the upper portion.

The other primary part of the crate 200 is an upper portion 240. The upper portion 240 is also preferably rotationally molded from plastic and double-walled. The upper portion 240 has a top 242 and at least one upper portion wall 246. The top 242 and the at least one upper portion wall 246 together form a cover or lid or overhead enclosure 248 into which components, tools, and informational materials likewise can be stored and from which they can be retrieved. For example, clear plastic pockets or pouches 247 might be attached to the interior of the overhead enclosure 248 to hold manuals. Preferably, the upper portion 240 has a shape whereby the top 242 is level or parallel with the ground when the crate is closed and there are three upper wall portions, a front wall portion 246.2 that is rectangular or trapezoidal and two side wall portions 246.4 and 246.6 that are generally triangular. The back edge 244 of the upper portion 240 is connected to the storage compartment back 220 using a hinge 270. The upper portion walls 246 have a bottom circumferential edge 250 that is constructed and arranged to abut with the top circumferential edge 226. The bottom circumferential edge 250 likewise may be flat or may have ridges, recesses, or other structure (not shown) for aligning or securing the base portion 210 with the upper portion 240.

The brace 272 used to suspend the upper portion 240 over the base portion 210, when the crate 200 is in an open position, may be mechanical, pneumatic, or other kind of support known to those skilled in the art. The preferred brace 272 is an air spring in a piston attached to the upper portion 240 and base portion 210 by connecting bosses (not shown) formed at the attachment points during the rotational molding processes. The bottom circumferential edge 250 and/or the top circumferential edge 226 may have a recess within which to nest the brace.

The crate 200 may include wheels 274 on the bottom 212 to increase its ease of mobility. The preferred embodiment has four wheels, one at each corner of the bottom 212. The crate 200 may include structure, such as recesses 276, to enhance the structural strength of the crate. The crate 200 may also include at least one latch or lock 280 to prevent the crate from inadvertently opening. Preferably the crate 200 has two locks 280. Each lock may have an ejector spring so that when the crate 200 is unlocked, the lock 280 does not interfere with opening and closing the crate 200. The storage compartment 216 of the preferred embodiment may be constructed to receive a permanently securable framework, although an alternative embodiment might include removable or even freestanding configurations of frame works, or other system of organization.

The preferred embodiment of the crate has a height of approximately 48 inches, a length of approximately 48 inches, and a depth of approximately 27 inches. Alternative embodiments may include crates having a height of approximately 3½ feet to 8½ feet, a length of approximately 3½ feet to 7 feet, and a depth of approximately 2 feet to 5 feet.

Figure 7:
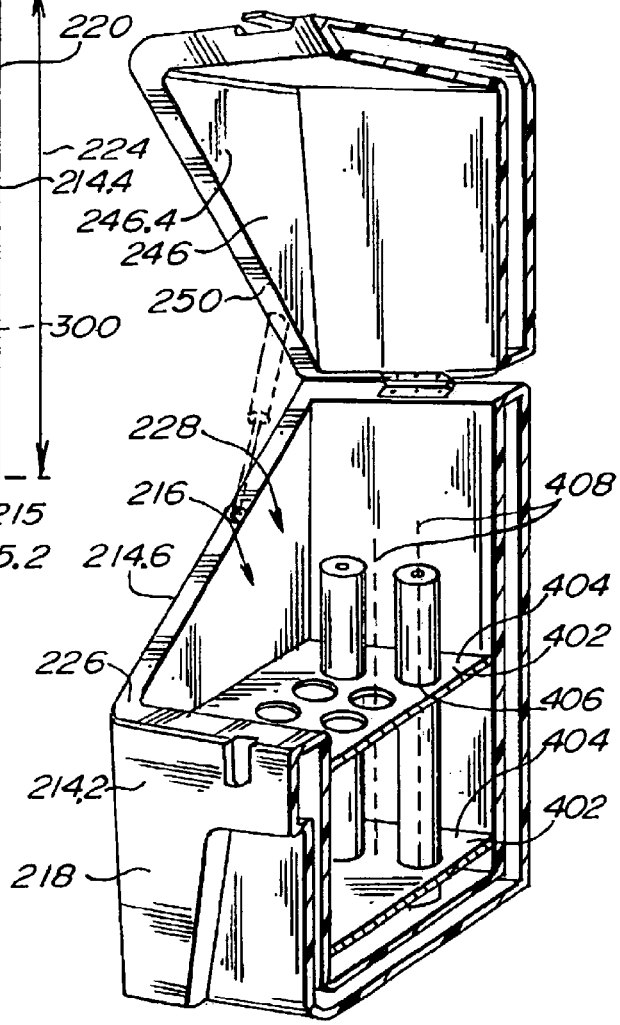
FIG. 7 is a perspective view of the crate with the right side cut away showing an embodiment of the framework.
Figure 5:
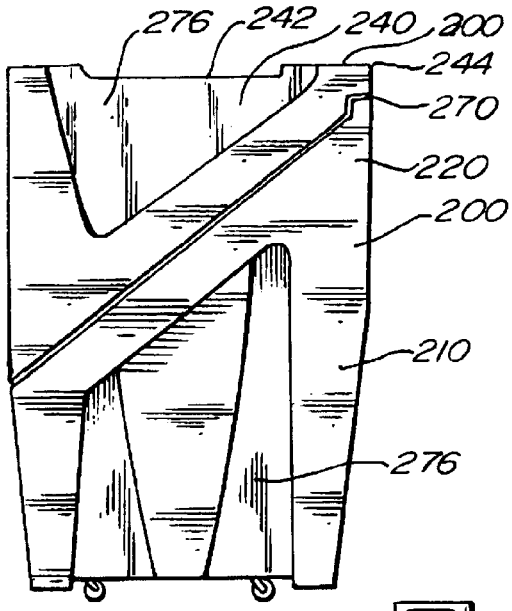
FIG. 5 is a right side view of the crate in closed position.
Figure 6:
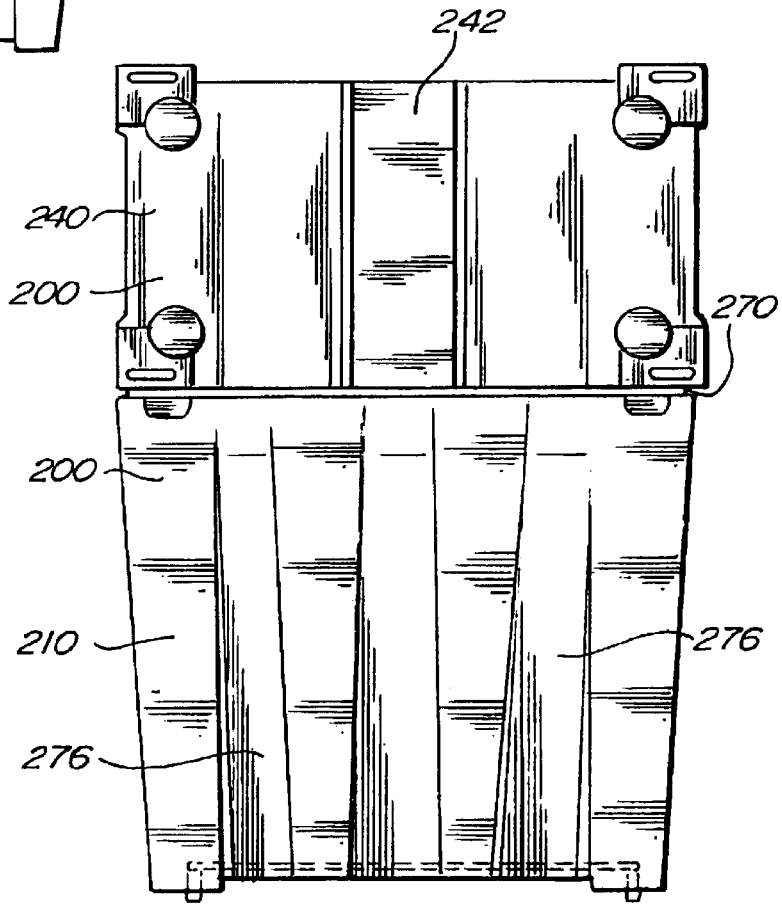
FIG. 6 is a back side view of the crate in an open position.

Referring to FIG. 7, the preferred embodiment of the framework 300 is comprised of two retainer panels 402. The retainer panels 402 have planar surfaces 404 that are horizontally positioned in the storage compartment 216 of the base portion 210 of the crate 200. The retainer panels 402 may be secured to the crate 200 by several different means known to those skilled in the art. At least one retainer panel 402 has an aperture 406 through its planar surface, through which a display component is positioned and secured for storage, although retainer panels 402 may have a plurality of apertures 406 depending on the needs of a particular display system. Each aperture 406 may be of a standard size and shape or of a particular size and shape intended to receive certain components. The latter configuration provides for more secure storage of components, especially if components are not uniformly shaped, and for storing and retrieving components in an order. The retainer panels 402 may be positioned one above the other with aligning apertures 408 being of different sizes and/or shapes, or an aperture may be altogether missing from a retainer panel 402, to receive components of predetermined sizes and shapes. Moreover, retainer panels 402 may be insertable into and removable from the crate so that the crate is adaptable to the needs of different display systems.

Figure 4:
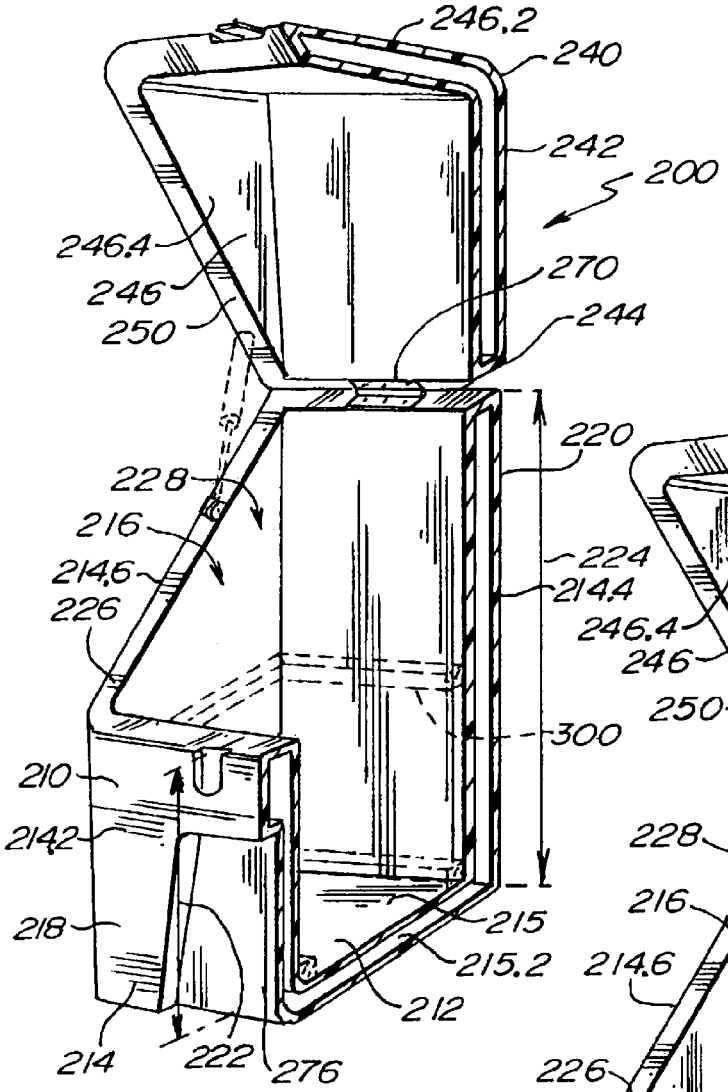
FIG. 4 is a perspective view of the crate with the right side cut away.
Figure 8:
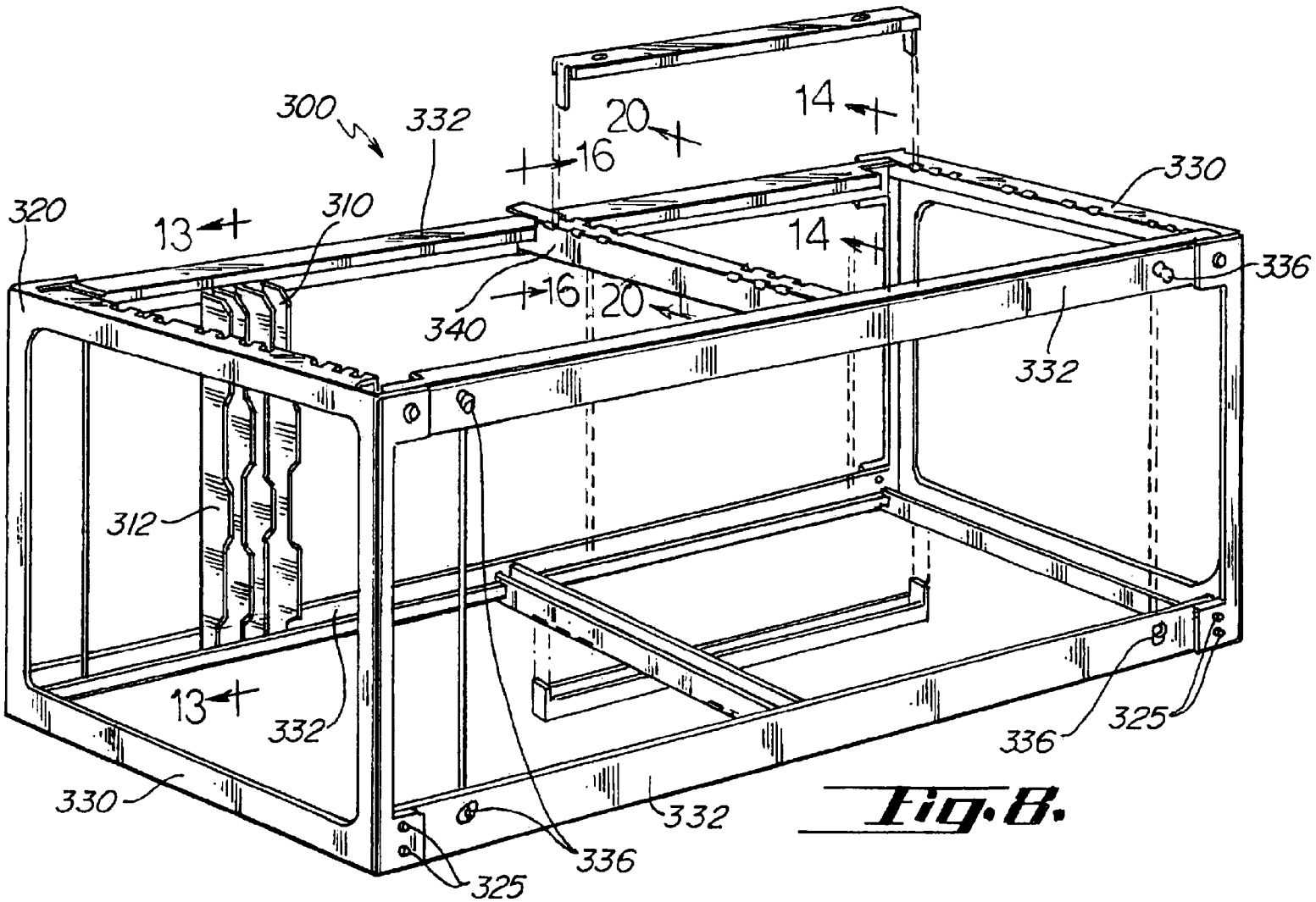
FIG. 8 is a perspective view of an alternative embodiment of the framework.
Figure 9:
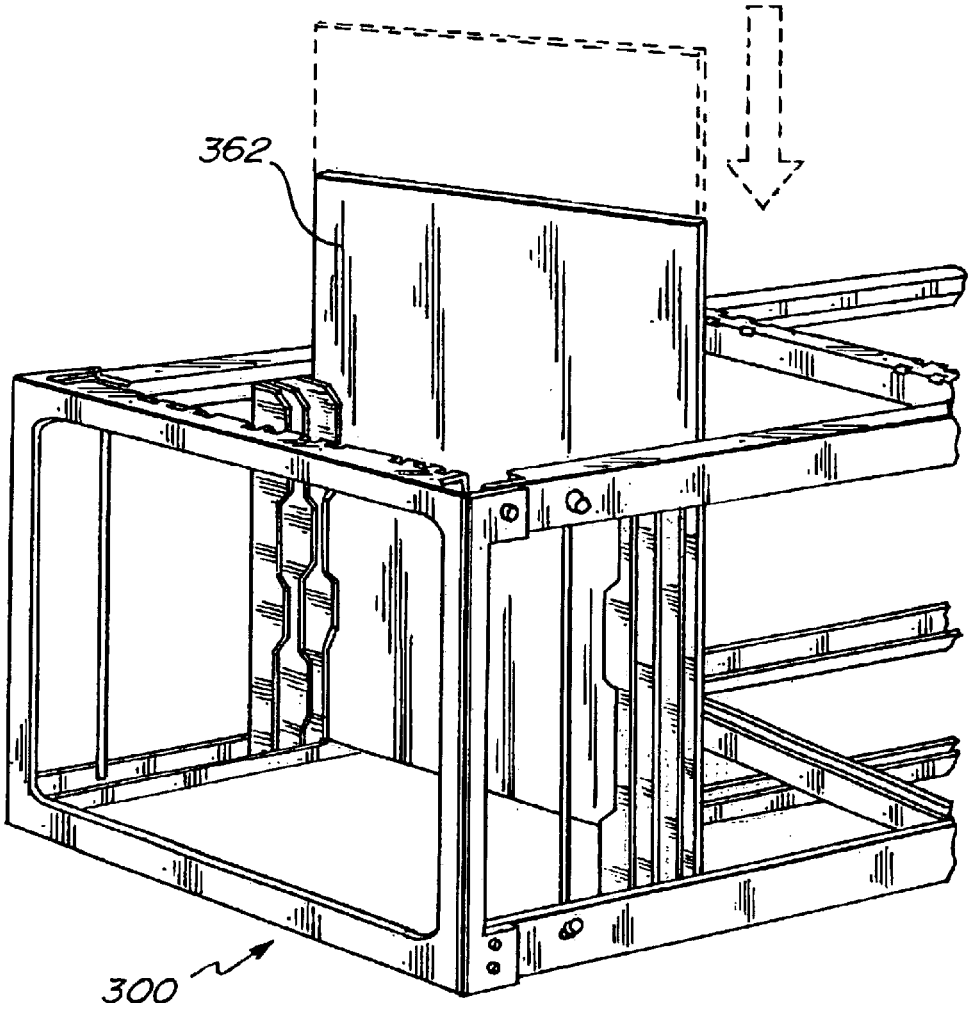
FIG. 9 is a perspective view of the framework in FIG. 8, receiving a display panel.
Figure 10:
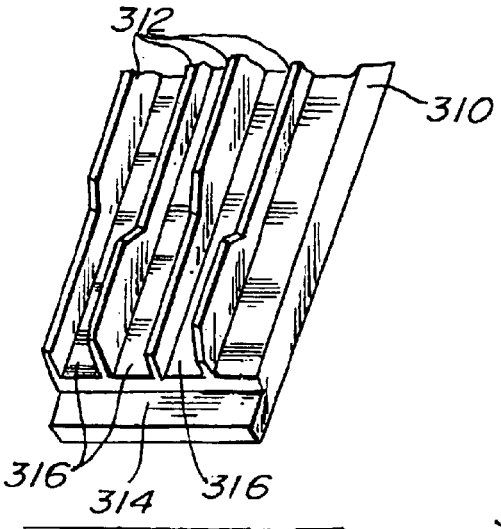
FIG. 10 is a partial perspective view of a retainer panel of the framework in FIG. 8.
Figure 11:
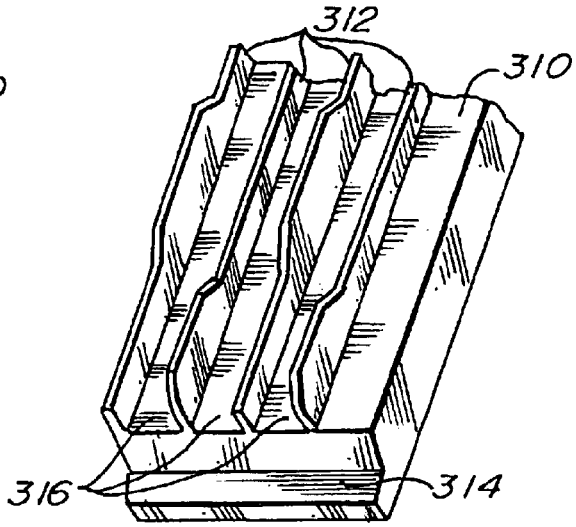
FIG. 11 is a partial perspective view of a retainer panel of the framework in FIG. 8.
Figure 12:
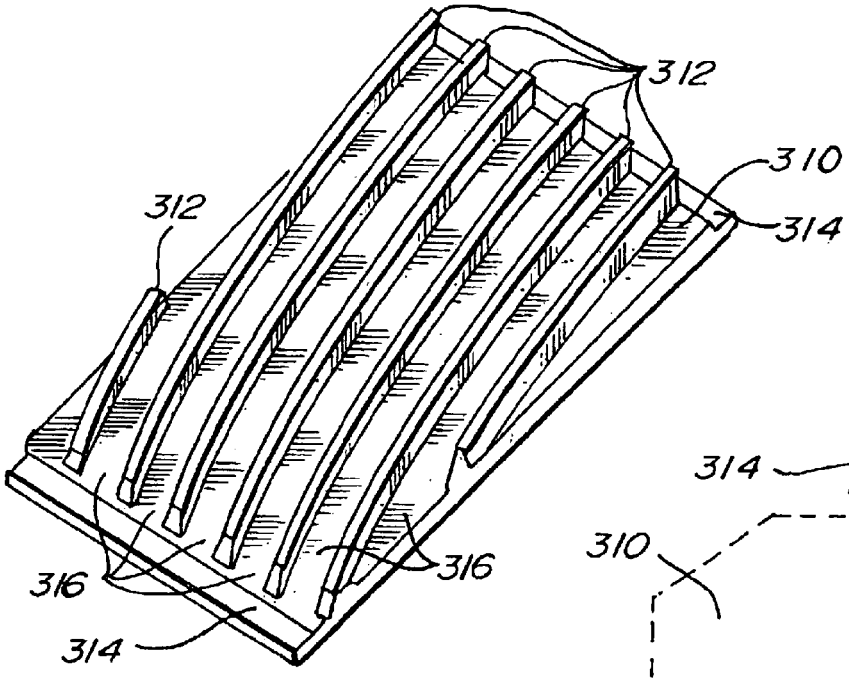
FIG. 12 is a perspective view of a retainer panel of the framework in FIG. 8, having curvilinear flutes.
Figure 13:
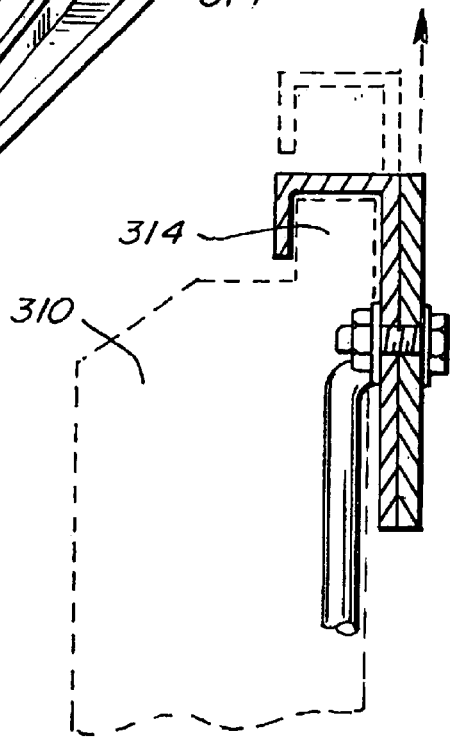
FIG. 13 is a cross-sectional view of a top retainer panel securing member of the framework in FIG. 8.
Figure 14:
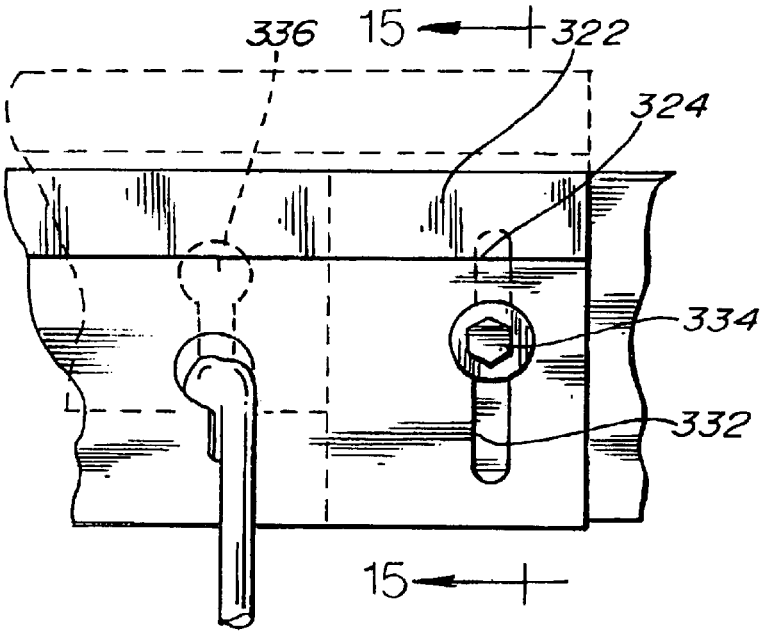
FIG. 14 is a close-up view of an end of a top retainer panel securing member of the framework in FIG. 8.
Figure 15:
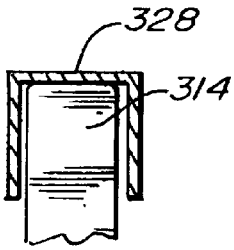
FIG. 15 is a cross-sectional view of a retainer panel securing member of the framework in FIG. 8.
Figure 16:
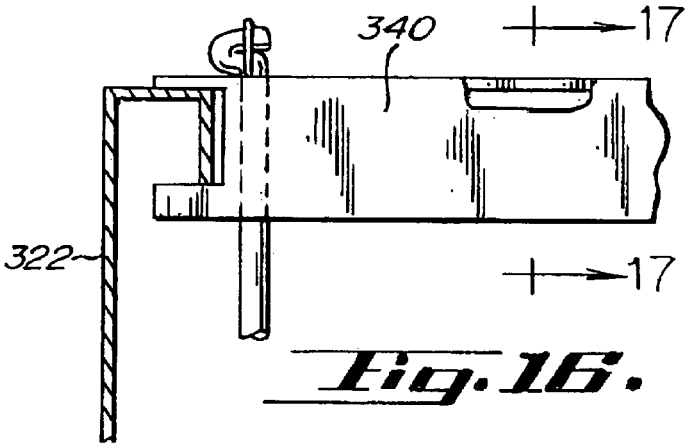
FIG. 16 is a close-up view of a cross-brace of the framework in FIG. 8, connected to a retainer panel securing member.
Figure 17:
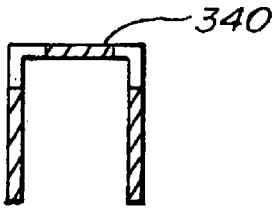
FIG. 17 is a cross-sectional view of a cross-brace of the framework in FIG. 8.
Figure 18:
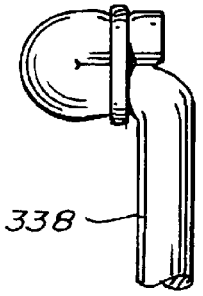
FIG. 18 is a perspective view of one end of a bungee cord used to bias a framework member of the framework in FIG. 8.
Figure 19:
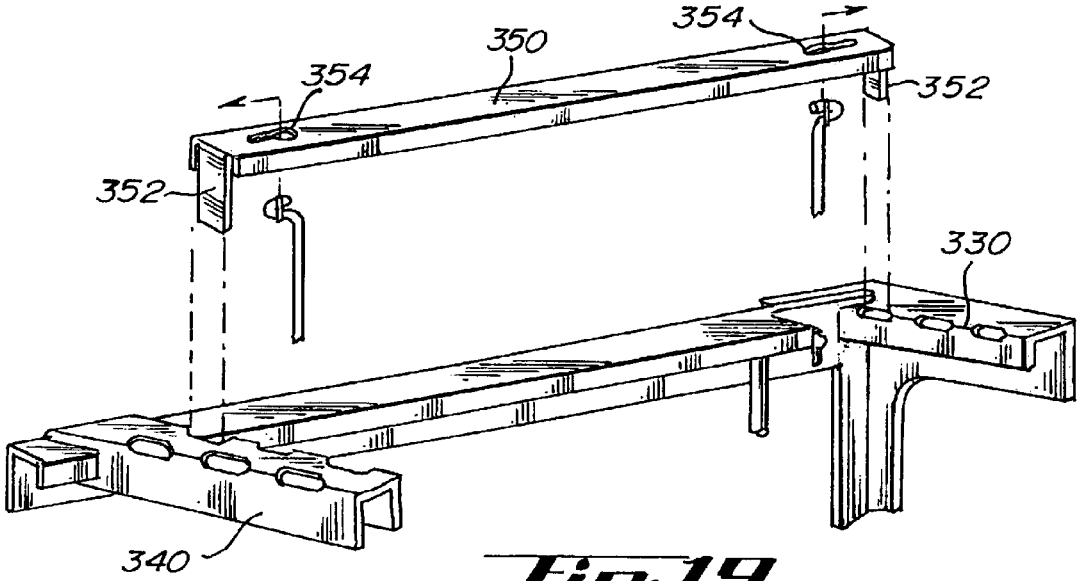
FIG. 19 is an exploded view of one configuration for connecting a small retainer panel securing member of the framework in FIG. 8.
Figure 20:
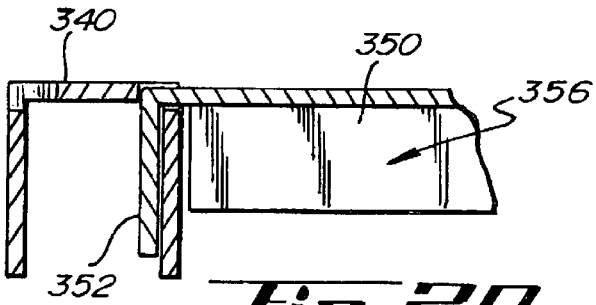
FIG. 20 is a cross-sectional view of a small retainer panel securing member of the framework in FIG. 8, connected to a cross-brace.

Referring to FIGS. 4, 8 and 9, an alternative embodiment of the framework 300 can be bolted or otherwise attached into a crate 200 or other container or case or may be used freestanding. As shown in FIG. 8, the alternative embodiment of the framework 300 includes at least one retainer panel 310 and a frame 320. As shown in FIGS. 8–13, the preferable shape of a retainer panel 310 is generally flat and rectangular with a plurality of flutes 312 vertically traversing the retainer panel 310. The retainer panel 310 may be neither flat nor rectangular. For example, the shape may be curvilinear instead of flat. The flutes 312 in the preferred embodiment are configured vertically and may be either linear or curvilinear. A retainer panel 310 is preferably vacuum formed from ⅛ inch polyethylene and has key shaped top and bottom ends 314 for positioning each end 314 into a channel or rail for securing the retainer panel 310 to the frame 320. In the alternative embodiment, retainer panel channels 316 created by the flutes 312 have predetermined widths appropriate for the component that is to be retained in the retainer panel channel 316 and thereby create an order to storing and retrieving components. This ordering may extend across several retainer panels. The retainer panels 310 are generally used in opposing pairs in the alternative embodiment.

In the alternative embodiment, retainer panels have a height of approximately 20¼ inches and a width of from approximately 4 inches to 12 inches. Alternative embodiments may include retainer panels having a height or a width from approximately 6 inches to approximately 5 feet.

As shown in FIGS. 8, 9, and 13–18, the frame 320 of the preferred embodiment includes two rectangular end plates 330, to which four retainer panel securing members 322 are each attached to a corner of each of the end plates 330. The two top retainer panel securing members 322 have a vertically oriented slot 324, preferably one at each end, for a bolt or boss to fit through, to connect these retainer panel securing members 322 to the end plates 330 and so that the top retainer panel securing members 322 are movable between an adjustment position 332 for moving a retainer panel 310 and a securing position 334 for securing a retainer panel. The bottom two retainer panel securing members 322 are immovably fixed to the end plates, for example, with bolts through bolt holes 325. Each of the retainer panel securing members 322 is configured to form a right-angled securing channel or rail 328 to receive a key-shaped end 314 of a retainer panel 310, and each retainer panel securing member 322 has a keyhole 336 through which a bungee cord 338 is hooked to bias the top retainer panel securing members 322 between the adjustment position 332 and the securing position 334. Other ways of connecting a bungee cord are known to those skilled in the art, for example, using an eyelet. In the preferred embodiment, each end of a retainer panel securing member 322 has a keyhole 336 adjacent and internal to each slot 324 or bolt hole 325 for attaching a bungee cord 338. In alternative embodiments, the bungee cord may be replaced by a metal spring piece, rubber tube or cord, or similar elastic part known to those skilled in the art.

The frame of the alternative embodiment is made of channel shaped steel and has a height of approximately 24 inches, a depth of approximately 27 inches and a length of approximately 48 inches. Alternative embodiments may include frames having a height between approximately 2 to 8½ feet, a depth between approximately 2 to 5 feet, and a length of approximately 3½ to 5 feet.

Many permutations of this framework design are possible. For example, the end plates of the framework could be a multitude of configurations to accomplish their purpose of holding the retainer panel securing members in a specific configuration. The framework may be collapsible. It is also possible, if the framework is integrated into an object such as a crate or container or case, that the end plates may be replaced by linear braces attached to the object or even eliminated, and even the bottom retainer panel securing members may be unnecessary. For example, a movable retainer panel securing member could be attached directly to the object with bolts through both the object and slots in the movable retainer panel securing member. A bungee cord could be connected to the movable retainer panel securing member and the object, and a retainer panel could be secured between a channel in the floor of the object and one in the movable retainer panel securing member. Retainer panel securing members may be curvilinear or some other shape instead of linear, and retainer panels may be slidable or fixed in place within the securing channel or rail. Retainer panels may be supplementally fixed in place in many ways known to those skilled in the art, such as using screws, plugs, rail clamps or screws, interlocking grooves in retainer panels and securing channels or rails, or anti-friction material on the interior surface of a securing channel or rail.

As shown in FIGS. 7, 8, and 16–20, to shorten the span across the frame between opposing retaining panels 310, a cross-brace 340 can be attached to and across the top retaining panel securing members 322 and another to and across the bottom retaining panel securing members 322. Notches in each end of a cross-brace 340 are used to position and fit the cross-brace over the rail 328 of a retainer panel securing member 322 in the preferred embodiment. Alternative ways of attaching a cross-brace 340 to a retainer panel securing member 322 are known to those skilled in the art, such as screwing the parts together. Two cross-brace members or a cross-brace member and an end plate are spanned both on the top and the bottom by short retaining panel securing members 350. These short retaining panel securing members 350 have tabs 352 on each end to fit into appropriately positioned slots 342 on the cross-braces 340 and a keyhole aperture 354 adjacent and internal to each end for connecting a pair of bungee cords 338 used to bias the short retaining panel securing panels 350 against a pair of cross-braces 340 or a cross-brace 340 and an end plate 330. The short retaining panel securing members 350 likewise are configured to have right-angled securing channels or rails 356 into which a retaining panel 310 might be positioned and secured. While the general shape of each cross-brace 340 and short retaining panel securing member 350 in the preferred embodiment is linear, these parts are curvilinear or some other shape in alternative embodiments. In still another alternative embodiment, short retaining panel securing members 350 are telescopic.

While the framework in the preferred embodiment is situated so that components are lowered into and raised from the framework, the framework may be used in alternative embodiments so that components are pushed into and pulled horizontally from the framework. The framework, for example, then could be used with a front loading object. In another embodiment, the organized storage system or the crate alone may be designed specifically for or in combination with a predetermined modular, collapsible display or similar system 360. Examples of such displays are illustrated in U.S. Pat. Nos. Des. 349,608, Des. 333,322, Des. 317,469, 4,991,813, 5,375,641 and U.S. Provisional Application No. 60/390,489. As shown is FIGS. 2 and 8, the modules of these displays may be, for example, modular, collapsible column and other display structure parts 366, display panels 362 with graphics, large sheets 364, and other parts known to those skilled in the art. These parts can be stored in an order in the retainer panel channels 316 and between cross-brace members 340 or a cross-brace member 340 and an end plate 330 of an independent framework 300 or a framework 300 inside a crate 200.

To use the framework, a user pulls up on one or both top retainer panel securing members, usually until the members reach their adjustment positions as delineated by the slots in the retainer panel securing members. While holding either or both retainer panel securing members up, a selected retainer panel is positioned into each securing channel or rail of two opposing retainer panel securing members or short retainer panel securing members for securing the retaining panel to the frame. The activity of positioning a retainer panel may include removing another retainer panel from the frame or moving another retainer panel to another location within the frame. The top retainer panel securing member is then allowed to return to its securing position.

The crate is manufactured for holding components of a disassembled, collapsible display by rotationally molding a display crate base having a bottom wall, a base left side wall, a base right side wall, a base front side wall, and a base rear side wall, together defining a storage compartment, the base front side wall having a height and the base rear side wall having a height, the height of the base front side wall being lower than the height of the base rear side wall, whereby the four base side walls and the bottom are all double-walled and integral with one another; rotationally molding a display crate upper portion comprising an upper front side wall, an upper right side wall, an upper left side wall, and a top wall, whereby the upper side walls and the top wall are all double-walled and integral with one another; and hingedly connecting the display crate upper portion to the display crate base. The method of manufacturing the crate may further comprise assembling a framework in the storage compartment of the display crate base, the framework defining recesses for holding a plurality of components of the disassembled collapsible display. Moreover, the method of manufacturing the crate may further securing the framework pieces together with at least one bungee cord.

Although the preferred embodiments of the organized storage system have been described herein, it should be recognized that numerous changes and variations can be made and that the scope of the present invention is to be defined by the claims.

What is claimed is:

1. A transportable crate in combination with the components of a collapsible display system assembleable into a display and disassembleable into a plurality of display components, the crate comprising:

a base portion further comprising a bottom, and at least one base portion wall forming a storage compartment with the bottom and having a top circumferential edge defining an opening into the storage compartment, wherein the storage compartment has a front having a height and a back having a height and the height of the front is lower than the height of the back;

an upper portion further comprising a top, and at least one upper portion wall forming an overhead enclosure with the top and having a bottom circumferential edge that is constructed and arranged to abut with the top circumferential edge of the base portion to enclose the storage compartment, wherein the upper portion is hingably connected to the back of the storage compartment;

at least one brace connected to the base portion and the upper portion to suspend the upper portion in an open position above the base portion;

a framework having at least one retainer panel and positioned inside the storage compartment to organize and secure the display components; and wherein the display components are placeable into the crate.

2. The combination of claim 1, wherein the framework organizes the display components in an order.

3. The combination of claim 1, wherein the at least one retainer panel has a planar surface positioned horizontally in the storage compartment, and wherein the horizontal surface has at least one aperture to receive a component of the display system.

4. The combination of claim 3, wherein the planar surface of the retainer panel has a plurality of apertures for receiving components of the display system in an order.

5. The combination of claim 1, wherein each retainer panel is insertable into and removable from the crate so that the crate is adaptable to different display systems.

6. The combination of claim 1, wherein the range of motion of the upper portion is limited so that the center of gravity of the crate remains above the bottom of the base portion.

7. The combination of claim 1, wherein the top of the upper portion has a back edge and wherein the upper portion is hingably connected to the base portion along the back edge of the top.

8. The combination of claim 1, wherein the crate has a plurality of structural recesses for enhancing the structural strength of the crate.

9. The combination of claim 1, wherein the bottom circumferential edge and the top circumferential edge have ridges and recesses for aligning and stabilizing the upper portion on the base portion.

10. The combination of claim 1, wherein the at least one brace comprises at least one air spring in a piston attached to the upper portion and the base portion.

11. The combination of claim 1, wherein the crate has at least one lock having an ejector spring positioned in the lock so that once opened, the lock does not interfere with opening or closing the crate.

12. The combination of claim 1, wherein the base portion and the upper portion are double walled, rotationally molded plastic.

13. A transportable crate in combination with the components of a collapsible display system assembleable into a display and disassembleable into a plurality of display components, the crate comprising:

a base portion further comprising a bottom, and at least one base portion wall forming a storage compartment with the bottom and having a top circumferential edge defining an opening into the storage compartment, wherein the storage compartment has a front having a height and a back having a height and the height of the front is lower than the height of the back;

an upper portion further comprising a top, and at least one upper portion wall forming an overhead enclosure with the top and having a bottom circumferential edge that is constructed and arranged to abut with the top circumferential edge of the base portion to enclose the storage compartment, wherein the upper portion is hingably connected to the back of the storage compartment;

at least one brace connected to the base portion and the upper portion to suspend the upper portion in an open position above the base portion; and wherein the display components are placeable into the crate.

14. A transportable crate for storing, protecting, and transporting components of collapsible display systems, comprising:

a base portion further comprising a bottom, and at least one base portion wall forming a storage compartment with the bottom and having a top circumferential edge defining an opening into the storage compartment, wherein the storage compartment has a front having a height and a back having a height and the height of the front is lower than the height of the back;

an upper portion further comprising a top, and at least one upper portion wall forming an overhead enclosure with the top and having a bottom circumferential edge that is constructed and arranged to abut with the top circumferential edge of the base portion to enclose the storage compartment, wherein the upper portion is hingably connected to the back of the storage compartment;

at least one brace connected to the base portion and the upper portion to suspend the upper portion in an open position above the base portion; and wherein the upper portion and the base portion are double walled, rotationally molded plastic.

15. A reconfigurable framework for organizing components of collapsible display systems, comprising:

at least one retainer panel having a plurality of flutes for holding components in place;

a frame having at least one retainer panel securing member to position and secure a retainer panel to the frame, wherein the at least one retainer panel securing member securing the retainer panel is movable between an adjustment position for moving the retainer panel and a securing position for securing the retainer panel; and at least one bungee cord is connected to and used to bias the at least one moveable retainer panel securing member between the adjustment position and the securing position.

16. The framework of claim 15, wherein the at least one moveable retainer panel securing member has at least one keyhole aperture and the at least one bungee cord is connected to the at least one moveable retainer panel securing member by hooking it through the at least one keyhole aperture.

17. The framework of claim 15, wherein the at least one moveable retainer panel securing member is connected to and biased by at least one biasing member selected from the group consisting of a spring, a resilient metal piece, rubber tube, and rubber cord.

18. The framework of claim 15, wherein the at least one movable retainer panel securing member has at least one slot that delineates the adjustment position and the securing position.

19. The framework of claim 15, wherein the at least one retainer panel securing member is attachable to the interior of a storage device.

20. The framework of claim 15, wherein the at least one retainer panel securing member is configured as a rail to receive the at least one retainer panel.

21. The framework of claim 15, wherein the frame is made of channel iron steel.

22. The framework of claim 15, wherein the flutes of the at least one retainer panel are vertically oriented.

23. The framework of claim 15, wherein the flutes of the at least one retainer panel are arranged so that the components of the display system are storable in an order.

24. The framework of claim 15, further comprising a plurality of retainer panels, wherein the retainer panels may be arranged so that the components of a display system are storable in an order.

25. The framework of claim 15, wherein the framework further comprises at least one cross-brace member, and wherein the at least one cross-brace member is aligned with and attached to a retainer panel securing member.

26. The framework of claim 25, wherein the frame further comprises at least one short retainer panel securing member configured to position and secure a retainer panel to the frame, and wherein the at least one short retainer panel securing member is biased against a cross-brace member using at least one bungee cord connected to the at least one short retainer panel securing member.

27. The framework of claim 26, wherein the at least one short retainer panel securing member is telescopic.

28. The framework of claim 25, wherein the framework is collapsible.

29. A method of configuring a reconfigurable framework for organizing components of collapsible display systems, comprising:

a) providing a reconfigurable framework having at least one retainer panel, at least one retainer panel securing member that is movable between an adjustment position for moving a retainer panel and a securing position for securing a retainer panel, and at least one biasing member connected to the at least one retainer panel securing member to bias the at least one retainer panel securing member between the adjustment position and the securing position;

b) selecting at least one retainer panel;

c) moving the at least one retainer panel securing member to the adjustment position;

d) positioning the at least one selected retainer panel into the desired position for securing the at least one selected retainer panel to the at least one retainer panel securing member; and e) allowing the at least one retainer panel securing member to return to the securing position.

30. The method of configuring a reconfigurable framework of claim 29, wherein the at least one biasing member is selected from the group consisting of a bungee cord, spring, sheet metal piece, rubber tube, and rubber cord.

31. A reconfigurable framework for organizing components of collapsible display systems, comprising:

at least two retainer panels having a plurality of flutes for holding components in place;

a frame having two end plates and four retainer panel securing members for positioning and securing the at least two retainer panels to the frame, wherein two retainer panel securing members are attached to the top of each of the end plates and two retainer panel securing members are attached to the bottom of each of the end plates, and wherein the top retainer panel securing members are movable between an adjustment position for moving the retainer panels and a securing position for securing the retainer panels; and a plurality of bungee cords, each connected to one top retainer panel securing member and one bottom retainer panel securing member to bias the top retainer panel securing member between the adjustment position and the securing position.

32. A transportable crate for storing, protecting, and transporting components of collapsible display systems, comprising:

a base portion further comprising a bottom, and at least one base portion wall forming a storage compartment with the bottom and having a top circumferential edge defining an opening into the storage compartment, wherein the storage compartment has a front having a height and a back having a height and the height of the front is lower than the height of the back;

an upper portion further comprising a top, and at least one upper portion wall forming an overhead enclosure with the top and having a bottom circumferential edge that is constructed and arranged to abut with the top circumferential edge of the base portion to enclose the storage compartment, wherein the upper portion is hingably connected to the back of the storage compartment;

at least one brace connected to the base portion and the upper portion to suspend the upper portion in an open position above the base portion at least one retainer panel having a plurality of flutes for holding components in place; and a frame having at least one retainer panel securing member, wherein a retainer panel is positioned and secured to the frame by the at least one retainer panel securing member, wherein at least one retainer panel securing member securing the retainer panel is movable between an adjustment position for moving the retainer panel and a securing position for securing the retainer panel.

33. A transportable crate for storing, protecting, and transporting components of collapsible display systems, comprising:

a base portion further comprising a bottom, and at least one base portion wall forming a storage compartment with the bottom and having a top circumferential edge defining an opening into the storage compartment, wherein the storage compartment has a front having a height and a back having a height and the height of the front is lower than the height of the back;

an upper portion further comprising a top, and at least one upper portion wall forming an overhead enclosure with the top and having a bottom circumferential edge that is constructed and arranged to abut with the top circumferential edge of the base portion to enclose the storage compartment, wherein the upper portion is hingably connected to the back of the storage compartment;

two pistons, each connected to the base portion and the upper portion and having an air spring for suspending the upper portion in an open position above the base portion;

at least two retainer panels having a plurality of flutes for holding components in place;

a frame having two end plates and four retainer panel securing members for positioning and securing the at least two retainer panels to the frame, wherein two retainer panel securing members are attached to the top of each of the end plates and two retainer panel securing members are attached to the bottom of each of the end plates, and wherein the top retainer panel securing members are movable between an adjustment position for moving the retainer panels and a securing position for securing the retainer panels; and four bungee cords, each connected to a top retainer panel securing member and a bottom retainer panel securing member for biasing the retainer panel securing member between the adjustment position and the securing position.

34. A method for manufacturing a crate for holding components of a disassembled, collapsible display, the method comprising the steps of:

a) rotationally molding a display crate base having a bottom wall, a base left side wall, a base right side wall, a base front side wall, and a base rear side wall, together defining a storage compartment, the base front side wall having a height and the base rear side wall having a height, the height of the base front side wall being lower than the height of the base rear side wall, whereby the four base side walls and the bottom are all double-walled and integral with one another;

b) rotationally molding a display crate upper portion comprising an upper front side wall, an upper right side wall, an upper left side wall, and a top wall, whereby the upper side walls and the top wall are all double-walled and integral with one another; and c) hingedly connecting the display crate upper portion to the display crate base.

35. The method of claim 34, further comprising the step of assembling a framework in the storage compartment of the display crate base, the framework defining recesses for holding a plurality of components of the disassembled collapsible display.

36. The method of claim 35, further comprising the step of securing the framework pieces together with at least one bungee cord.

* * * * *